US006110588A

United States Patent [19]

Perez et al.

[11] Patent Number: 6,110,588

[45] Date of Patent: Aug. 29, 2000

[54] MICROFIBERS AND METHOD OF MAKING

[75] Inventors: Mario A. Perez, Burnsville; Michael D. Swan, Maplewood, both of Minn.; John W. Louks, Hudson, Wis.

[73] Assignee: 3M Innovative Properties Company, St. Paul, Minn.

[21] Appl. No.: 09/245,952

[22] Filed: Feb. 5, 1999

[51] Int. Cl.[7] ..... D01F 6/00

[52] U.S. Cl. ..... 428/359; 428/397

[58] Field of Search ..... 428/359, 370, 428/397, 399

[56] References Cited

U.S. PATENT DOCUMENTS

| | | | |
|---|---|---|---|
| Re. 31,285 | 6/1983 | van Turnhout et al. | 55/155 |
| 3,416,714 | 12/1968 | Skinner | 225/3 |
| 3,470,594 | 10/1969 | Kim | 28/72 |
| 3,470,685 | 10/1969 | Hall et al. | 57/140 |
| 3,490,663 | 1/1970 | Skinner | 225/93 |
| 3,500,626 | 3/1970 | Sandiford | 57/140 |
| 3,695,025 | 10/1972 | Gibbon | 57/140 |
| 3,719,540 | 3/1973 | Hall | 156/267 |
| 4,064,214 | 12/1977 | FitzGerald | 264/147 |
| 4,134,951 | 1/1979 | Dow et al. | 264/147 |
| 4,348,350 | 9/1982 | Meier et al. | 264/570 |
| 4,456,648 | 6/1984 | Adamse et al. | 428/283 |
| 4,524,101 | 6/1985 | Eickman et al. | 428/294 |
| 4,608,089 | 8/1986 | Gale et al. | 106/90 |
| 4,867,937 | 9/1989 | Li et al. | 264/290 |
| 4,973,517 | 11/1990 | Lammers et al. | 428/354 |
| 4,990,401 | 2/1991 | Renalls | 428/403 |
| 5,043,197 | 8/1991 | Renalls | 428/36.4 |
| 5,049,347 | 9/1991 | Magill et al. | 264/280 |
| 5,171,815 | 12/1992 | Magill et al. | 526/348.1 |
| 5,176,833 | 1/1993 | Vaughn et al. | 210/638 |

(List continued on next page.)

FOREIGN PATENT DOCUMENTS

| | | |
|---|---|---|
| 0 026 581 | 5/1983 | European Pat. Off. . |
| 0 806 512 A1 | 11/1997 | European Pat. Off. . |
| 4-194068 | 7/1992 | Japan . |
| 02 672188 | 11/1997 | Japan . |
| 1073741 | 6/1967 | United Kingdom . |
| 1157695 | 7/1969 | United Kingdom . |
| 1171543 | 11/1969 | United Kingdom . |
| 1234782 | 6/1971 | United Kingdom . |
| 1267298 | 3/1972 | United Kingdom . |
| 1541681 | 3/1979 | United Kingdom . |
| 2 034 243 | 6/1980 | United Kingdom . |
| 1605004 | 12/1981 | United Kingdom . |

OTHER PUBLICATIONS

Bigg, "Mechanical Property Enhancement of Semicrystalline Polymers", *Polymer Engineering and Science,* vol. 28, No. 13, pp. 830–841, Jul. 1988.

Davies, "The Separation of Airborne Dust and Particles", *Institution of Mechanical Engineers,* London, Proceedings 1B, 1952.

Doyle, "Strong Fabrics for Fast Sails", *Scientific American,* pp. 60–67, Jul. 1997.

Jones et al., "Crystalline Forms of Isotactic Polypropylene", *Makromol. Chem.,* vol. 75, 134–158, 1964.

Karger–Kocsis, Polypropylene: Structure, Blends and Composites, vol. 1, 130–131, 1994.

Kolpak et al., "Deformation of Cotton and Bacterial Cellulose Microfibrils", *Textile Research Journal,* pp. 568–572, Jul. 1975.

Piccarolo et al., "Crystallization of Polymer Melts Under Fast Cooling", *Journal of Applied Polymer Science,* vol. 46, 625–634, 1992.

Roger S. Porter et al., *Journal of Macromolecular Science–Rev. Macromol. Chem. Phys.,* C35(a), 63–115, 1995.

*Primary Examiner*—N Edwards
*Attorney, Agent, or Firm*—Kent S. Kokko

[57] ABSTRACT

Microfibers and microfibrillated articles are provided by imparting fluid energy to a surface of a highly oriented, highly crystalline, melt-processed polymeric film. The microfibers and microfibrillated articles are useful as tape backings, filters, thermal and acoustical insulation and as reinforcement fibers for polymers or cast building materials such as concrete.

10 Claims, 5 Drawing Sheets

U.S. PATENT DOCUMENTS

| | | | |
|---|---|---|---|
| 5,366,804 | 11/1994 | Dugan | 428/370 |
| 5,378,537 | 1/1995 | Masuda et al. | 428/364 |
| 5,387,388 | 2/1995 | Van Erden et al. | 264/280 |
| 5,434,002 | 7/1995 | Yoon et al. | 428/359 |
| 5,525,287 | 6/1996 | Van Erden et al. | 264/476 |
| 5,589,264 | 12/1996 | Yoon et al. | 428/359 |
| 5,695,709 | 12/1997 | Van Erden et al. | 264/476 |
| 5,698,489 | 12/1997 | Shirai et al. | 503/227 |
| 5,783,503 | 7/1998 | Gillespie et al. | 428/359 |
| 5,807,516 | 9/1998 | Wolstenholme et al. | 264/210.2 |
| 5,845,355 | 12/1998 | Strahm | 8/152 |
| 5,945,215 | 8/1999 | Bersted et al. | 428/364 |
| 5,945,221 | 8/1999 | Tsai et al. | 428/412 |

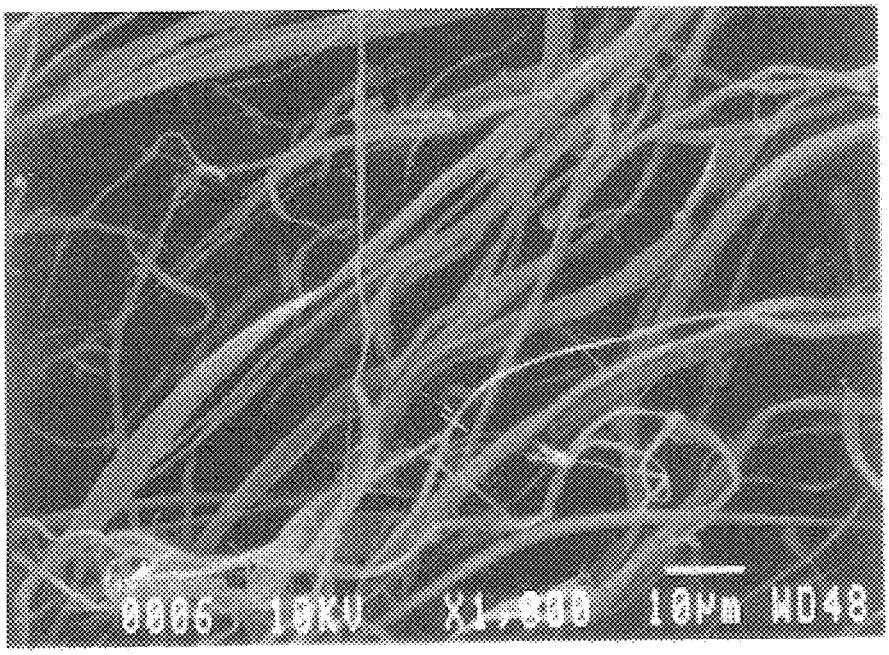
Fig. 1 10 μm
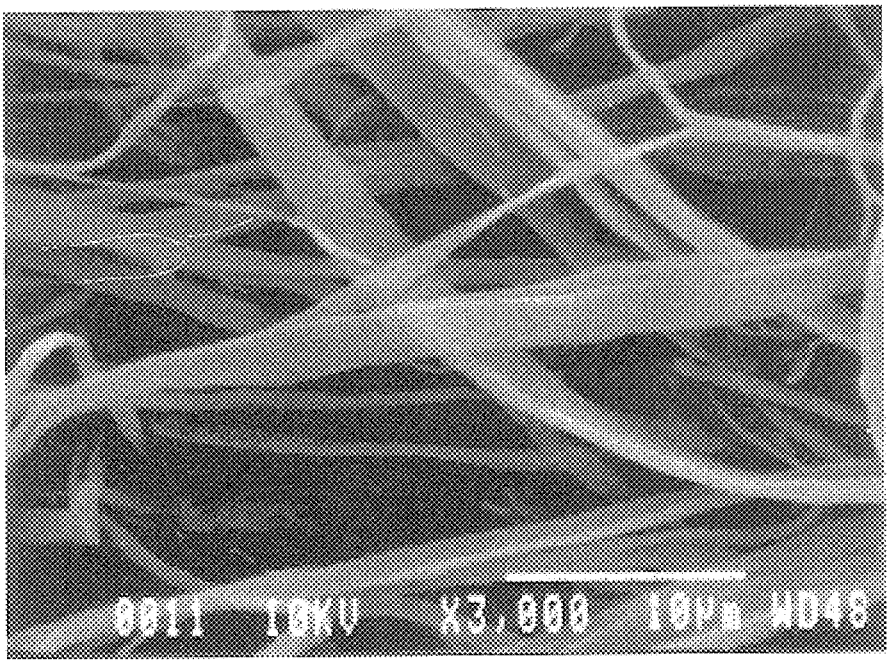
Fig. 2 10 μm

MICROFIBERS AND METHOD OF MAKING

FIELD OF THE INVENTION

The present invention relates to high-strength, high-modulus, melt-processed microfibers, films having a microfibrillated surface, and methods of making the same. Microfibers of the invention can be prepared by imparting fluid energy, typically in the form of ultrasound or high-pressure water jets, to a highly oriented, highly crystalline, melt processed film to liberate microfibers therefrom. Microfibrillated films of the invention find use as tape backings, filters, fibrous mats and thermal and acoustical insulation. Microfibers of the invention, when removed from the film matrix, find use as reinforcement fibers for polymers or cast building materials such as concrete.

BACKGROUND OF THE INVENTION

Polymeric fibers have been known essentially since the beginnings of commercial polymer development. The production of polymer fibers from polymer films is also well known. In particular, the ease with which films produce fibers (i.e., fibrillate) can be correlated to the degree of molecular orientation of the polymer fibrils that make up the film.

Orientation of crystalline polymeric films and fibers has been accomplished in numerous ways, including melt spinning, melt transformation (co)extrusion, solid state coextrusion, gel drawing, solid state rolling, die drawing, solid state drawing, and roll-trusion, among others. Each of these methods has been successful in preparing oriented, high modulus polymer fibers and films. Most solid-state processing methods have been limited to slow production rates, on the order of a few cm/min. Methods involving gel drawing can be fast, but require additional solvent-handling steps. A combination of rolling and drawing solid polymer sheets, particularly polyolefin sheets, has been described in which a polymer billet is deformed biaxially in a two-roll calender then additionally drawn in length (i. e., the machine direction). Methods that relate to other web handling equipment have been used to achieve molecular orientation, including an initial nip or calender step followed by stretching in both the machine direction or transversely to the film length.

Liberating fibers from oriented, high-modulus polymer films, particularly from high molecular weight crystalline films, has been accomplished in numerous ways, including abrasion, mechanical plucking by rapidly-rotating wire wheels, impinging water-jets to shred or slit the film, and application of ultrasonic energy. Water jets have been used extensively to cut films into flat, wide continuous longitudinal fibers for strapping or reinforcing uses. Ultrasonic treatment of oriented polyethylene film in bulk (that is, a roll of film immersed in a fluid, subjected to ultrasonic treatment for a period of hours) has been shown to produce small amounts of microfibrils.

SUMMARY OF THE INVENTION

The present invention is directed to novel highly oriented, melt processed polymeric microfibers having an effective average diameter less than 20 microns, generally from 0.01 microns to 10 microns, and substantially rectangular in cross section, having a transverse aspect ratio (width to thickness) of from 1.5:1 to 20:1, and generally about 3:1 to 9:1. Since the microfibers are substantially rectangular, the effective diameter is a measure of the average value of the width and thickness of the microfibers.

The rectangular cross-sectional shape advantageously provides a greater surface area (relative to fibers of the same diameter having round or square cross-section) making the microfibers (and microfibrillated films) especially useful in applications such as filtration and as reinforcing fibers in cast materials. The surface area is generally greater than about 0.25 $m^2$/gram, typically about 0.5 to 30 $m^2$/g. Further, due to their highly oriented morphology, the microfibers of the present invention have very high modulus, for example typically above $10^9$ Pa for polypropylene fibers, making them especially useful as reinforcing fibers in thermoset resin and concrete.

The present invention is further directed toward the preparation of highly-oriented films having a microfibrillated surface by the steps of providing a highly oriented, semicrystalline polymer film, stretching the film to impart a microvoided surface thereto, and then microfibrillating the microvoided surface by imparting sufficient fluid energy thereto. Optionally the microfibers may be harvested from the microfibrillated surface of the film.

Advantageously the process of the invention is capable of high rates of production, is suitable as an industrial process and uses readily available polymers. The microfibers and microfibrillated articles of this invention, having extremely small fiber diameter and both high strength and modulus, are useful as tape backings, strapping materials, films with unique optical properties and high surface area, low density reinforcements for thermosets, impact modifiers or crack propagation prevention in matrices such as concrete, and as fibrillar forms (dental floss or nonwovens, for example).

BRIEF DESCRIPTION OF THE FIGURES

FIG. 1 is a digital image of a scanning electron micrograph of the microfibers of Example 1 at 1000× magnification.

FIG. 2 is a digital image of a scanning electron micrograph of the microfibers of Example 1 at 3000× magnification.

DETAILED DESCRIPTION

Figure 3:
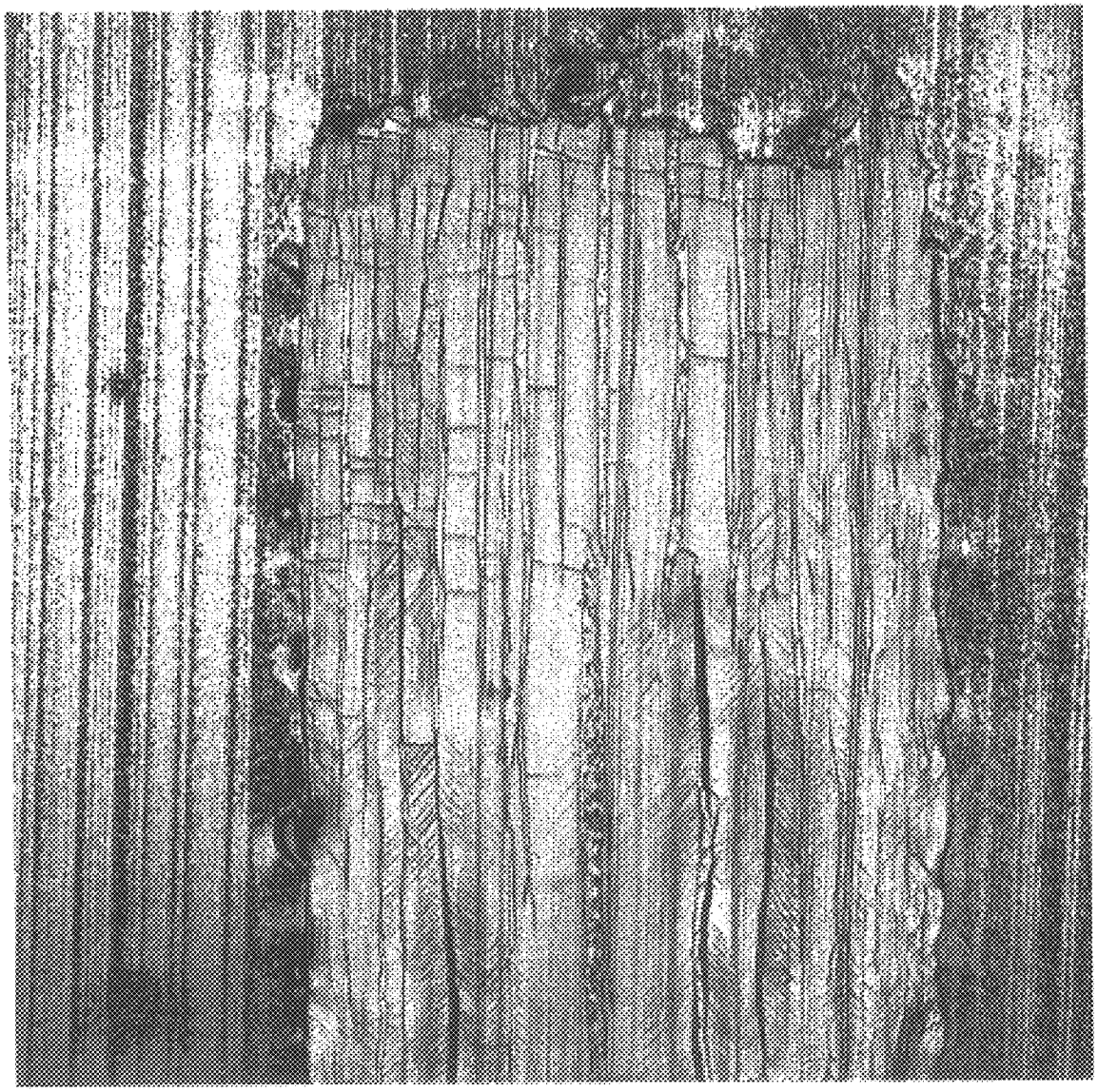
FIG. 3 is a digital image of a confocal light micrograph of a cross-section of the microvoided film of Sample 2–7 at 3000×magnification.

Polymers useful in the present invention include any melt-processible crystalline, semicrystalline or crystallizable polymers. Semicrystalline polymers consist of a mixture of amorphous regions and crystalline regions. The crystalline regions are more ordered and segments of the chains actually pack in crystalline lattices. Some crystalline regions may be more ordered than others. If crystalline regions are heated above the melting temperature of the polymer, the molecules become less ordered or more random. If cooled rapidly, this less ordered feature is "frozen" in place and the resulting polymer is said to be amorphous. If cooled slowly, these molecules can repack to form crystalline regions and the polymer is said to be semicrystalline. Some polymers are always amorphous and show no tendency to crystallize. Some polymers can be made semicrystalline by heat treatments, stretching or orienting and by solvent inducement, and these processes can control the degree of true crystallinity.

Many semicrystalline polymers produce spherulites on crystallization, beginning with nucleation through various stages of crystal growth. Spherulites are birefringent, usually spherical structures that are generally observed by optical techniques such as polarizing optical microscopy. Spherulites are not single crystals, rather they are aggregates of smaller crystalline units called crystallites. Crystallites range in diameter, depending on the polymers and processing conditions, from $10^{-5}$ to $10^{-8}$ m. The lower limit for size of spherulites has been estimated to be about $10^{-6}$ m according to microscopy studies, but the upper limit is constrained by the number of nucleation sites in the crystallizing polymer.

Spherulites result from the radial growth of fibrillar subunits, the individual fibrils or bundles of fibrils that constitute the basic unit for spherulites. The fibrils themselves are of submicroscopic dimensions and often only visible by electron microscopy. However, if the subunits are of sufficient size, they may be observed microscopically. These larger sized fibrils are generally composed of bundles of microfibrils, which in turn are composed of crystallite subunits. Observations suggest that spherulite fibrillar growth occurs radially from the nucleating site and that the individual molecules are oriented perpendicular to the radii (see, for example, L. H. Sperling, *Introduction to Physical Polymer Science,* John Wiley and Sons. NY, N.Y. 1986). The perpendicular orientation of the polymer chains with respect to the fibrillar axis is a consequence of chain folding, leading to tangential orientation of the molecules in spherulites, since fibrils grow radially from the nucleation site.

The terms "amorphous", "crystalline", "semicrystalline", and "orientation" are commonly used in the description of polymeric materials. The true amorphous state is considered to be a randomly tangled mass of polymer chains. The X-ray diffraction pattern of an amorphous polymer is a diffuse halo indicative of no regularity of the polymer structure. Amorphous polymers show softening behaviors at the glass transition temperature, but no true melt or first order transition. The semicrystalline state of polymers is one in which long segments of the polymer chains appear in both amorphous and crystalline states or phases. The crystalline phase comprises multiple lattices in which the polymer chain assumes a chain-folded conformation (lamellae) in which there is a highly ordered registry in adjacent folds of the various chemical moieties of which the chain is constructed. The packing arrangement (short order orientation) within the lattice is highly regular in both its chemical and geometric aspects. Semicrystalline polymers show characteristic melting points, above which the crystalline lattices become disordered and rapidly lose their identity. Either concentric rings or a symmetrical array of spots, which are indicative of the nature of the crystalline order, generally distinguishes the X-ray diffraction pattern of semicrystalline polymers (or copolymers).

Semicrystalline polymers useful in the present invention include, but are not limited to, high and low density polyethylene, polypropylene, polyoxymethylene, poly (vinylidine fluoride), poly(methyl pentene), poly(ethylene-chlorotrifluoroethylene), poly(vinyl fluoride), poly(ethylene oxide), poly(ethylene terephthalate), poly(butylene terephthalate), nylon 6, nylon 66, polybutene, and thermotropic liquid crystal polymers. Examples of suitable thermotropic liquid crystal polymers include aromatic polyesters which exhibit liquid crystal properties when melted and which are synthesized from aromatic diols, aromatic carboxylic acids, hydroxycarboxylic acids, and other like monomers. Typical examples include a first type consisting of parahydroxybenzoic acid (PHB), terephthalic acid, and biphenol; a second type consisting of PHB and 2,6-hydroxynaphthoic acid; and a third type consisting of PHB, terephthalic acid, and ethylene glycol. Preferred polymers are polyolefins such as polypropylene and polyethylene that are readily available at low cost and can provide highly desirable properties in the microfibrillated articles such as high modulus and high tensile strength.

The molecular weight of the polymer should be chosen so that the polymer is melt processible under the processing conditions. For polypropylene and polyethylene, for example, the molecular weight may be from about 5000 to 499,000 and is preferably from about 100,000 to 300,000.

Organic polymers typically comprise long molecular chains having a backbone of carbon atoms. The theoretical strength of the polymers and the facility with which the surface of a polymer film can be microfibrillated often are not realized due to random orientation and entanglement of the polymer chains. In order to obtain the maximum physical properties and render the polymer film amenable to fibrillation, the polymer chains need to be oriented substantially parallel to one another and partially disentangled. The degree of molecular orientation is generally defined by the draw ratio, that is, the ratio of the final length to the original length. This orientation may be effected by a combination of techniques in the present invention, including the steps of calendering and length orienting.

Films are generally defined, for example, by the *Modern Plastic Encyclopedia,* as thin in relation to the width and length, and having a nominal thickness of no greater than about 0.25 mm. Materials of greater thickness are generally defined as sheets. As used herein, the term "film" shall also encompass sheets and it may also be understood that other configurations and profiles such as tubes may be provided with a microfibrillated surface with equal facility using the process of this invention.

In the present invention, a highly oriented, semicrystalline, melt processed film is provided having an induced crystallinity. Induced crystallinity is the maximized crystallinity that may be obtained by an optimal combination of casting and subsequent processing such as calendering, annealing, stretching and recrystallization. For polypropylene, for example, crystallinity is above 60%, preferably above 70%, most preferably above 75%. The crystallinity may be measured by differential scanning calorimetry (DSC) and comparison with extrapolated values for 100% crystalline polymers. For example, see B. Wunderlich, *Thermal Analysis,* Academic Press, Boston, Mass., 1990.

Generally, the crystallinity of commercially available cast films must be increased to be useful in the process of the invention. Cast films, such as those prepared by extrusion from a melt followed by quenching on a cooled casting drum, exhibit a "spontaneous crystallinity" that results from conventional processing conditions. For example, isotactic polypropylene cast films typically exhibit crystallinity of 59–61% by DSC analysis. When using such polypropylene film in the process of the invention, it is desirable to increase the crystallinity at least 20% above this "spontaneous crystallinity" value, to about 72% or higher. It is believed that maximizing the crystallinity of the film will increase microfibrillation efficiency.

Any suitable combination of processing conditions may be used to impart the maximum induced crystallinity and orientation to the melt-processed film. These may include any combination of casting, quenching, annealing, calendering, orienting, solid-state drawing, roll-trusion and the like. Such processing generally also serves to increase the degree of crystallinity of the polymer film as well as the size and number of the spherulites. The suitability of a film for subsequent process steps may be determined by measuring degree of crystallinity of the polymer film by, for example, x-ray diffraction or by differential scanning calorimetry (DSC).

Highly oriented polymer films, suitable for subsequent processing to impart a microvoided morphology, are known and/or commercially available. These have been described for example by Nippon Oil, Tokyo; Polteco, Hayward, Calif.; Cady Industries Inc, Memphis Tenn.; and Signode Packaging Systems, Glenview Ill.

Microvoids are microscopic voids in the film, or on the surface of the film, which occur when the film is unable to conform to the deformation process imposed. By "unable to conform" it is meant that the film is unable to sufficiently relax to reduce the stress caused by the imposed strain. The highly oriented highly crystalline polymer films are stretched under conditions of plastic flow that exceed the ability of the polymer to conform to the imposed strain, thereby imparting a microvoided morphology thereto. In conventional film orientation processes, such excessive stresses are avoided since they lead to weaknesses in the film and may result in breakage during orientation. During an orientation process step of the present invention there occur small breakages or tears (microvoids) when the deformation stress due to orientation exceeds the rate of disentangling of the polymer molecules. See, for example, Roger S. Porter and Li-Hui Wang, *Journal of Macromolecular Science-Rev. Macromol. Chem. Phys.,* C35(1), 63–115 (1995).

Depending on how the film is processed to induce crystallinity and how the film is oriented, one or both surfaces may have significant microvoid content, in addition to significant microvoid content in the bulk of the film. When orienting the film by stretching in the machine direction, microvoids are typically distributed throughout the x, y and z axes of the film, generally following the fibril boundaries, and appearing as microscopic defects or cracks.

Microvoids are relatively planar in shape, irregular in size and lack distinct boundaries. Microvoids at the surface of the film are generally transverse to the machine direction (direction of orientation) of the film, while those in the matrix of the film are generally in the plane of the film, or perpendicular to the plane of the film with major axes in the machine direction (direction of orientation). Microvoid size, distribution and amount in the film matrix may be determined by techniques such as small angle x-ray scattering (SAXS), confocal microscopy or density measurement. Additionally, visual inspection of a film may reveal enhanced opacity or a silvery appearance due to significant microvoid content.

Generally, the greater the microvoid content, the greater the yield of microfibers by the process of this invention. Preferably, when preparing an article having at least one microfibrillated surface, at least one major surface of the polymer film should have a microvoid content in excess of 5%, preferably in excess of 10%, as measured by density; i.e., the ratio of the density of the microvoided film with that of the starting film. Microvoided films useful in the present invention may be distinguished from other voided films or articles, such as microporous films or foamed articles in that the microvoids are generally non-cellular, relatively planar and have major axes in the machine direction (direction of orientation) of the film. The microvoids do not generally interconnect, but adjacent microvoids may intersect.

In practice, the films first may be subjected to one or more processing steps to impart the desired degree of crystallinity and orientation, and further processed to impart the microvoids, or the microvoids may be imparted coincident with the process step(s) which impart crystallinity. Thus the same calendering or stretching steps that orient the polymer film and enhance the crystallinity (and orientation) of the polymer may concurrently impart microvoids.

In one embodiment of the present invention, the polymer is extruded from the melt through a die in the form of a film or sheet and quenched to maximize the crystallinity of the film by retarding or minimizing the rate of cooling. As the polymer cools from the melt, it begins to crystallize and spherulites form from the developing crystallites. If cooled rapidly from a temperature above its melting point to a temperature well below the crystallization temperature, a structure is produced comprising crystallites surrounded by large amorphous regions, and the size of the spherulites is minimized.

In one embodiment, the film is quenched on a heated casting drum that is maintained at a temperature above the glass transition temperature, but below the melt temperature. Normally, polypropylene, for example, is cold quenched at about 24° C. (75° F.), but in the present process, for example, a hot quench from a melt at about 220° C. (450° F.) to a quench temperature of about 82° C.(180° F.) is used. This higher quenching temperature allows the film to cool slowly and the crystallinity of the film to increase due to annealing. Preferably quenching occurs at a rate to not only maximize the crystallinity, but to maximize the size of the crystalline spherulites.

The effect of casting temperature and cooling rate on the crystallinity is known and reference may be made to S. Piccarolo et al., *Journal of Applied Polymer Science,* vol. 46, 625–634 (1992).

Alternatively to casting on a heated casting drum, the film may be quenched in air or in a fluid such as water, which may be heated, to allow the film to cool more slowly and allow the crystallinity and spherulite size to be maximized. Air or water quenching may ensure the uniformity of the crystallinity and spherulite content across the thickness of the film. Depending on the thickness of the extruded article and the temperature of the casting drum, the morphology of the polymer may not be the same across the thickness of the article, i.e., the morphology of the two surfaces may be different. The surface in contact with the heated casting drum may be substantially crystalline, while the surface remote from the casting drum may have similar morphology due to exposure to the ambient air where heat transfer is less efficient. Small differences in morphology do not normally prevent the formation of a microfibrillated surface on either major surface on the film, but if microfibrillated surfaces are desired on both surfaces of the article, it is preferred that the temperature of the casting wheel be carefully controlled to ensure uniform crystallinity across the thickness of the article.

Alternatively to casting on a heated casting wheel, the film may be rapidly quenched to a temperature below the crystallization temperature and the crystallinity increased by stress induced crystallization; for example, by drawing at a draw ratio of at least 2:1. The drawing tension should be sufficient to produce alignment of the molecules and deformation of the spherulites by inducing the required plastic deformation above that produced by flow drawing.

After casting (and drawing, if any), the polymer may be characterized by a relatively high crystallinity and significant spherulite formation. The size and number of the spherulties is dependent of the casting conditions. The degree of crystallinity and presence of spherulite structures may be verified by, for example, x-ray diffraction and electron microscopy.

The thickness of the film will be chosen according to the desired end use and can be achieved by control of the process conditions. Cast films will typically have thicknesses of less than 100 mils (2.5 mm), and preferably between 30 and 70 mils (0.8 to 1.8 mm). However, depending on the characteristics desired for the resultant article, they may be cast at thicknesses outside of this range.

In a preferred embodiment the cast film is calendered after quenching. Calendering allows higher molecular orientation to be achieved by enabling subsequent higher draw ratios. In the absence of a calendering step, subsequent draw ratios in the orienting step above the natural draw ratio (7:1 for polypropylene) are generally not achievable without risking breakage. Calendering at the appropriate temperature can reduce the average crystallite size through shearing and cleaving of the entanglements, and may impose an aspect ratio on the spherulites (i.e. flatten in the transverse direction and elongate in the machine direction). Calendering is preferably performed at or above the alpha crystallization temperature. The alpha crystallization temperature, $T\alpha c$, corresponds to the temperature at which crystallite subunits are capable of being moved within the larger lamellar crystal unit. Above this temperature lamellar slip can occur, and extended chain crystals form, with the effect that the degree of crystallinity is increased as amorphous regions of the polymer are drawn into the lamellar crystal structure. The calendering step has the effect of orienting the fibrils into the plane of the film from the original radially oriented sphere. The crystallites are cleaved due to the shear forces, which may be verified by wide-angle x-ray. Thus the individual fibrils are largely radial from the nucleating site, but lie in the same plane.

After calendering, the article is then oriented in the machine direction by stretching under conditions of plastic flow, that are insufficient to cause catastrophic failure of the film, (i.e., in excess of the ability of the polymer to conform to the strain). Using polypropylene, for example the films may be stretched at least 5 times its length. In a preferred embodiment, when considering both the calendering and orienting steps, the combined draw ratio is at least 10:1 and preferably in the range of 10:1 to about 40:1 for polypropylene.

The orientation (stretching) step is preferably done immediately after the calendering step, i.e., the calendered film is fed directly from the calender nip to the length orienting equipment. A minimum gap between the calender nip to the first length-orienting roller minimizes cooling and avoids creasing of the film. The tension of the length-orienting machine is maintained so that essentially no relaxation occurs during the orientation step and orientation imparted during calendering is maintained. Preferably the length orientation apparatus comprises a plurality of orientation rollers, whose relative speeds are controlled so as to impart a gradual draw or orientation to the film. Further the plurality of rollers may be temperature controlled to provide a gradual temperature decrease to the oriented film and thereby maximize the orientation.

The stretching conditions are chosen to impart microvoids (in excess of 5% as measured by the change in density) to the surface of the film. Generally the stretching conditions may be chosen such that, under plastic flow (at a given minimum temperature and maximum stretch ratio), the temperature is reduced about 10° C. or more, or the strain imposed is increased about 10% (stretched about 10% further) to induce microvoids. Also, the temperature may be decreased and the stretch ratio increased at the same time, as long as conditions are chosen so as to exceed the ability of the polymer to conform to the strain imposed and avoiding catastrophic failure of the film.

Microvoids are small defects that occur when the film is drawn at a tension, under conditions of plastic flow, exceeding that at which the film is able to conform to the stress imposed. Or at a speed that is faster than the relaxation rate of the film (the rate of detanglement of the polymer chains). The occurrence of a significant amount of microvoids will impart an opalescent or silvery appearance to the surface of the film due to light scattering from the defects. In contrast, film surfaces lacking significant microvoids have a transparent appearance. The presence of microvoids may be verified by small-angle x-ray or density measurement, or by microscopy. The appearance can serve as an empirical test of the suitability of an oriented film for the production of a microfibrillated surface. It has been found that an oriented film lacking in significant amount of microvoids is not readily microfibrillated, even though the film may be split longitudinally, as is characteristic of highly oriented polymer films having a fibrous morphology.

Figure 6:
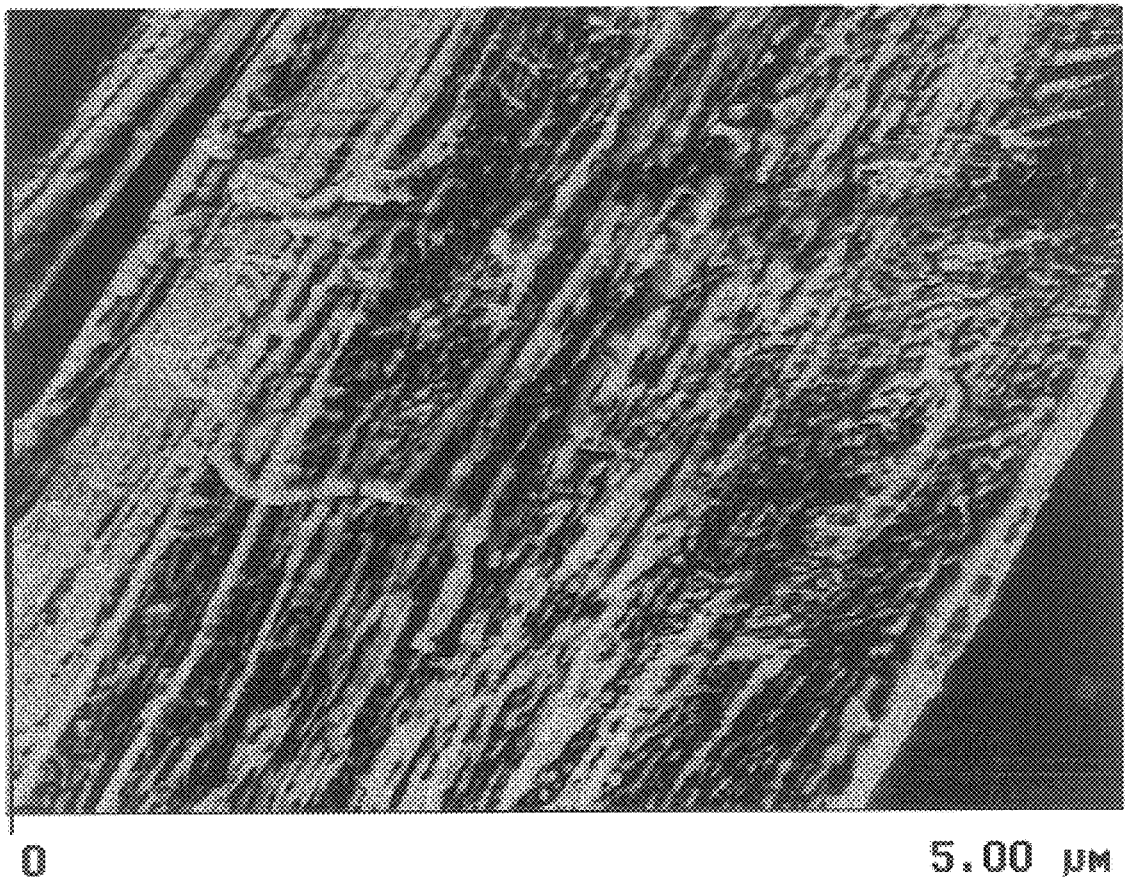
FIG. 6 is a digital image of an atomic force micrograph (tapping mode) of a microfiber of the invention.

In the orienting step, the individual fibrils of the spherulites are drawn substantially parallel to the machine direction (direction of orientation) of the film and in the plane of the film. The calendered, oriented fibrils can be visualized as having a rope-like appearance. See FIG. 6. By confocal light microscopy, the microtomed film reveals a microfibrous morphology in which microvoids may be observed. See FIG. 3.

The final thickness of the film will be determined in part by the casting thickness, the calendering thickness and the degree of orientation. For most uses, the final thickness of the film prior to fibrillation will be 1 to 20 mils (0.025 to 0.5 mm), preferably 3 to 10 mils (0.075 to 0.25 mm).

The highly-oriented, highly crystalline film is then microfibrillated by imparting sufficient fluid energy to the surface to release the microfibers from the polymer matrix. Optionally, prior to microfibrillation, the film may be subjected to a fibrillation step by conventional mechanical means to produce macroscopic fibers from the highly oriented film. The conventional means of mechanical fibrillation uses a rotating drum or roller having cutting elements such as needles or teeth in contact with the moving film. The teeth may fully or partially penetrate the surface of the film to impart a fibrillated surface thereto. Other similar macrofibrillating treatments are known and include such mechanical actions as twisting, brushing (as with a porcupine roller), rubbing, for example with leather pads, and flexing. The fibers obtained by such conventional fibrillation processes are macroscopic in size, generally several hundreds of microns in cross section. Such macroscopic fibers are useful in a myriad of products such as particulate filters, as oil absorbing media, and as electrets.

The oriented film is microfibrillated by imparting sufficient fluid energy thereto to impart a microfibrillated surface, for example, by contacting at least one surface of the film with a high-pressure fluid. In a microfibrillation process, relatively greater amounts of energy are imparted to the film surface to release microfibers, relative to that of a conventional mechanical fibrillation process. Microfibrils are several orders of magnitude smaller in diameter than the fibers obtained by mechanical means (such as with a porcupine roller) ranging in size from less than 0.01 microns to 20 microns. In the present invention, microfibers may be obtained (using polypropylene for example) having a degree of crystallinity in excess of 75%, a tensile modulus in excess of one million psi (~7 GPa). Surprisingly, the microfibers thus obtained are rectangular in cross section, having a cross sectional aspect ratio (transverse width to thickness) ranging from of about 1.5:1 to about 20:1 as can be seen in FIGS. 1 and 2. Further, the sides of the rectangular shaped microfibers are not smooth, but have a scalloped appearance in cross section. Atomic force microscopy reveals that the microfibers of the present invention are bundles of individual or unitary fibrils, which in aggregate form the rectangular or ribbon-shaped microfibers. See FIG. 6. Thus the surface area exceeds that which may be expected from rectangular shaped microfibers, and such surface enhances bonding in matrices such as concrete and thermoset plastics.

One method of microfibrillating the surface of the film is by means of fluid jets. In this process one or more jets of a fine fluid stream impact the surface of the polymer film, which may be supported by a screen or moving belt, thereby releasing the microfibers from the polymer matrix. One or both surfaces of the film may be microfibrillated. The degree of microfibrillation is dependent on the exposure time of the film to the fluid jet, the pressure of the fluid jet, the cross-sectional area of the fluid jet, the fluid contact angle, the polymer properties and, to a lesser extent, the fluid temperature. Different types and sizes of screens can be used to support the film.

Any type of liquid or gaseous fluid may be used. Liquid fluids may include water or organic solvents such as ethanol or methanol. Suitable gases such as nitrogen, air or carbon dioxide may be used, as well as mixtures of liquids and gases. Any such fluid is preferably non-swelling (i.e., is not absorbed by the polymer matrix), which would reduce the orientation and degree of crystallinity of the microfibers. Preferably the fluid is water. The fluid temperature may be elevated, although suitable results may be obtained using ambient temperature fluids. The pressure of the fluid should be sufficient to impart some degree of microfibrillation to at least a portion of the film, and suitable conditions can vary widely depending on the fluid, the nature of the polymer, including the composition and morphology, configuration of the fluid jet, angle of impact and temperature. Typically, the fluid is water at room temperature and at pressures of at least 3400 kPa (500 psi), although lower pressure and longer exposure times may be used. Such fluid will generally impart a minimum of 5 watts or 10 $W/cm^2$ based on calculations assuming incompressibility of the fluid, a smooth surface and no losses due to friction.

The configuration of the fluid jets, i.e., the cross-sectional shape, may be nominally round, but other shapes may be employed as well. The jet or jets may comprise a slot which traverses a section or which traverses the width of the film. The jet(s) may be stationary, while the film is conveyed relative to the jet(s), the jet(s) may move relative to a stationary film, or both the film and jet may move relative to each other. For example, the film may be conveyed in the machine (longitudinal) direction by means of feed rollers while the jets move transverse to the web. Preferably, a plurality of jets is employed, while the film is conveyed through the fibrillation chamber by means of rollers, while the film is supported by a screen or scrim, which allows the fluid to drain from the microfibrillated surface. The film may be microfibrillated in a single pass, or alternatively the film may be microfibrillated using multiple passes past the jets.

The jet(s) may be configured such that all or part of the film surface is microfibrillated. Alternatively, the jets may be configured so that only selected areas of the film are microfibrillated. Certain areas of the film may also be masked, using conventional masking agents to leave selected areas free from microfibrillation. Likewise the process may be conducted so that the microfibrillated surface penetrates only partially, or fully through the thickness of the starting film. If it is desired that the microfibrillated surface extend through the thickness of the film, conditions may be selected so that the integrity of the article is maintained and the film is not severed into individual yarns or fibers.

A hydroentangling machine, for example, can be employed to microfibrillate one or both surfaces by exposing the fibrous material to the fluid jets. Hydroentangling machines are generally used to enhance the bulkiness of microfibers or yarns by using high-velocity water jets to wrap or knot individual microfibers in a web bonding process, also referred to as jet lacing or spunlacing. Alternatively a pressure water jet, with a swirling or oscillating head, may be used, which allows manual control of the impingement of the fluid jet.

The microfibrillation may be conducted by immersing the sample in a high energy cavitating medium. One method of achieving this cavitation is by applying ultrasonic waves to the fluid. The rate of microfibrillation is dependent on the cavitation intensity. Ultrasonic systems can range from low acoustic amplitude, low energy ultrasonic cleaner baths, to focused low amplitude systems up to high amplitude, high intensity acoustic probe systems.

One method which comprises the application of ultrasonic energy involves using a probe system in a liquid medium in which the fibrous film is immersed. The horn (probe) should be at least partially immersed in the liquid. For a probe system, the fibrous film is exposed to ultrasonic vibration by positioning it between the oscillating horn and a perforated metal or screen mesh (other methods of positioning are also possible), in the medium. Advantageously, both major surfaces of the film are microfibrillated when using ultrasound. The depth of microfibrillation in the fibrous material is dependent on the intensity of cavitation, amount of time that it spends in the cavitating medium and the properties of the fibrous material. The intensity of cavitation is a factor of many variables such as the applied amplitude and frequency of vibration, the liquid properties, fluid temperature and applied pressure and location in the cavitating medium. The intensity (power per unit area) is typically highest beneath the horn, but this may be affected by focusing of the sonic waves.

The method comprises positioning the film between the ultrasonic horn and a film support in a cavitation medium (typically water) held in a tank. The support serves to restrain the film from moving away from the horn due to the extreme cavitation that takes place in this region. The film can be supported by various means, such as a screen mesh, a rotating device that may be perforated or by adjustment of tensioning rollers which feed the film to the ultrasonic bath. Film tension against the horn can be alternatively used, but correct positioning provides better fibrillation efficiency. The distance between the opposing faces of the film and the horn and the screen is generally less than about 5 mm (0.2 inches). The distance from the film to the bottom of the tank can be adjusted to create a standing wave that can maximize cavitation power on the film, or alternatively other focusing techniques can be used. Other horn to film distances can also be used. The best results typically occur when the film is positioned near the horn or at ¼ wavelength distances from the horn, however this is dependent factors such as the shape of the fluid container and radiating surface used. Generally positioning the sample near the horn, or the first or second ¼ wavelength distance is preferred.

The ultrasonic pressure amplitude can be represented as:

$P_0=2\pi B/\lambda=(2\pi/\lambda)\rho c^2 y_{max}$

The intensity can be represented as:

$I=(P_0)^2/2\rho c$ where $P_0$=maximum (peak) acoustic pressure amplitude

I=acoustic intensity

B=bulk modulus of the medium $\lambda$=wavelength in the medium $Y_{max}$=peak acoustic amplitude $\rho$=density of the medium, and c=speed of the wave in the medium Ultrasonic cleaner bath systems typically can range from 1 to 10 watt/cm$^2$ while horn (probe) systems can reach 300 to 1000 watt/cm$^2$ or more. Generally, the power density levels (power per unit area, or intensity) for these systems may be determined by the power delivered divided by the surface area of the radiating surface. However, the actual intensity may be somewhat lower due to wave attenuation in the fluid. Conditions are chosen so as to provide acoustic cavitation. In general, higher amplitudes and/or applied pressures provide more cavitation in the medium. Generally, the higher the cavitation intensity, the faster the rate of microfiber production and the finer (smaller diameter) the microfibers that are produced. While not wishing to be bound by theory, it is believed that high pressure shock waves are produced by the collapse of the incipient cavitation bubbles, which impacts the film resulting in microfibrillation.

The ultrasonic oscillation frequency is usually 20 to 500 kHz, preferably 20–200 kHz and more preferably 20–100 kHz. However, sonic frequencies can also be utilized without departing from the scope of this invention. The power density (power per unit area, or intensity) can range from 1 W/cm$^2$ to 1 kW/cm$^2$ or higher. In the present process it is preferred that the power density be 10 watt/cm$^2$ or more, and preferably 50 watt/cm$^2$ or more.

The gap between the film and the horn can be, but it is not limited to, 0.001 to 3.0 inches (0.03 to 76 mm), preferably 0.005 to 0.05 inches (0.13 to 1.3 mm). The temperature can range from 5 to 150° C., preferably 10 to 100° C., and more preferably from 20 to 60° C. A surfactant or other additive can be added to the cavitation medium or incorporated within the fibrous film. The treatment time depends on the initial morphology of the sample, film thickness and the cavitation intensity. This time can range from 1 millisecond to one hour, preferably from 1/10 of a second to 15 minutes and most preferably from ½ second to 5 minutes.

In the present process the degree of microfibrillation can be controlled to provide a low degree or high degree of microfibrillation. A low degree of microfibrillation may be desired to enhance the surface area by partially exposing a minimum amount of microfibers at the surface and thereby imparting a fibrous texture to the surface of the film. The enhanced surface area consequently enhances the bondability of the surface. Such articles are useful, for example as substrates for abrasive coatings and as receptive surfaces for printing, as hook and loop fasteners, as interlayer adhesives and as tape backings. Conversely, a high degree of fibrillation may be required to impart a highly fibrous texture to the surface to provide cloth-like films, insulating articles, filter articles or to provide for the subsequent harvesting of individual microfibers (i.e., removal of the microfibers from the polymer matrix).

In either microfibrillation process most of the microfibers stay attached to the web due to incomplete release of the microfibers from the polymer matrix. Advantageously the microfibrillated article, having microfibers secured to a web, provides a convenient and safe means of handling, storing and transporting the microfibers. For many applications it is desirable to retain the microfibers secured to the web. Further, the integral microfibers may be extremely useful in many filtering applications—the present microfibrillated article provides a large filtering surface area due to the microscopic size of the microfibers while the non-fibrillated surface of the film may serve as an integral support.

Optionally the microfibers may be harvested from the surface of the film by mechanical means such as with a porcupine roll, scraping and the like. Harvested microfibers generally retain their bulkiness (loft) due to the high modulus of the individual microfibers and, as such, are useful in many thermal insulation applications such as clothing. If necessary, loft may be improved by conventional means, such as those used to enhance the loft of blown microfibers, for example by the addition of staple fibers.

If desired, adjuvants may be added to the polymer melt to improve the microfibrillation efficiency, such as silica, calcium carbonate or micaceous materials or to impart a desired property to the microfibers, such as antistats or colorants. Further, nucleating agents may be added to control the degree of crystallinity or, when using polypropylene, to increase the proportion of β-phase polypropylene in the crystalline film. A high proportion of β-phase is believed to render the crystalline film more readily microfibrillated. β-phase nucleating agents are known and are described, for example, in Jones, et al., *Makromol. Chem.,* vol. 75, 134–158 (1964) and J. Karger-Kocsis, *Polypropylene: Structure, Blends and Composites,* vol. 1, 130–131(1994). One such beta nucleating agent is N',N',-dicyclohexyl-2,6-napthalene dicarboxamide, available as NJ-Star NU-100™ from New Japan Chemical Co. Chuo-ku, Osaka. Japan.

Figure 5:
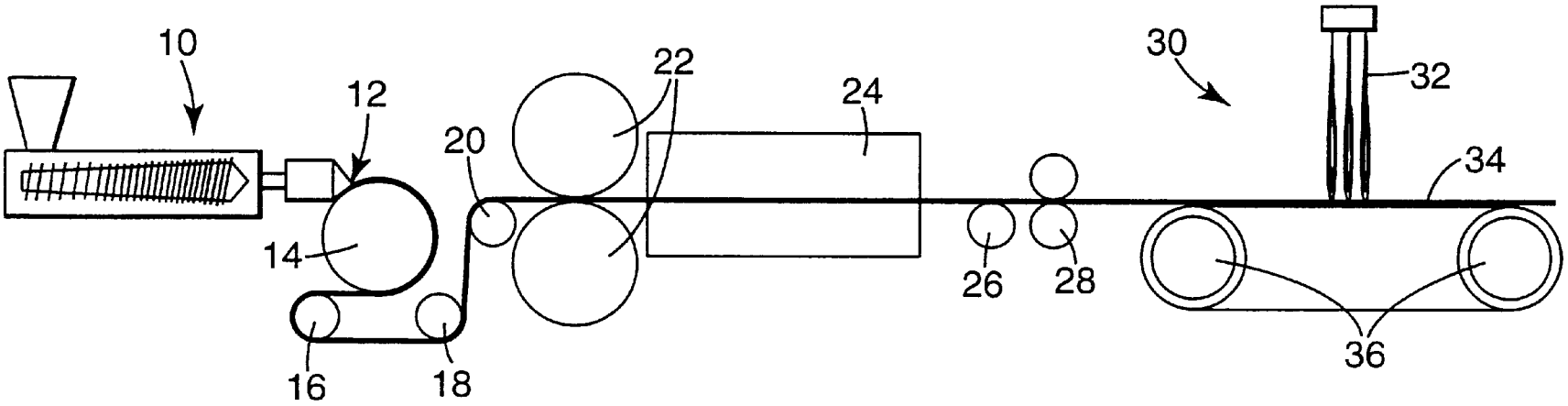
FIG. 5 is a schematic of the process of the invention.

Referring to FIG. 5, the extruder (10) supplies a molten, amorphous polymer via an extruder nip or orifice having a predetermined profile to produce a semi-molten film (12). The film is cast onto casting drum (14), having a temperature control means for quenching the film at the desired temperature and maximizing the crystallinity of the film. The casting drum may be heated to a temperature above the glass temperature or may be maintained at a temperature suitable for cold quenching. If cold quenching is desired, the cast film is preferably immediately stretched by means of a length orienting device (not shown). The casting wheel for example may be solid or hollow and heated by means of a circulating fluid, resistance heaters, air impingement or heat lamps.

The cast film is fed by means of tensioning guide rollers (16), (18) and (20) to calendering apparatus (22) wherein the profile of the film is reduced by a draw ratio of at least 2:1 to impart a degree of orientation thereto. Calendering apparatus (22) is temperature controlled so as to impose the desire deformation and maximize cleavage of the crystallites. The calendered film is fed to a length orienting apparatus (24) by means of feed rollers (not shown) whereby the film is stretched beyond the natural draw ratio in the machine direction. The length orienting apparatus may comprise a plurality of rollers which provide tension in the machine direction. Generally, the downweb rollers rotate at rates faster than the upweb rollers to maintain the desired tension. Preferably the rollers are maintained at temperatures optimum for orienting a particular polymer, for example about 130° C. for polypropylene. More preferably the rollers are maintained in a sequence of decreasing temperature so that highest possible draw rates may be achieved. After orienting, the film is cooled on a cooling wheel (not shown) and removed form the apparatus by take-off rollers (not shown).

Preferably, the calendering apparatus and the length orienting apparatus are so disposed to provide a minimum gap between the nip rollers of the calendering apparatus and the idler rollers of the orienting apparatus to avoid relaxation of the calendered film prior to length orientation.

The highly oriented film may be fed to the fibrillation apparatus (30) as shown in the figure, or may be stored for later use. Preferably the film is fed directly to the microfibrillation apparatus (30) via rollers 28. Microfibrillation of the film may optionally include a macrofibrillation step whereby the film is subjected to a mechanical fibrillation by means of a porcupine roller (26) to expose a greater surface area of the fiber or fiber bundles. In the present process it is generally not necessary to mechanically macrofibrillate the film, although subsequent microfibrillation may be enhanced by surface roughening.

Microfibrillation apparatus (30) may comprise one or more fluid jets (32) which impact the film with sufficient fluid energy to microfibrillate the surface. The film may be conveyed on support belt (34) driven by rollers (36). The belt is typically in the form of a screen that can provide mechanical support and allow the fluid to drain.

Alternatively, the apparatus may comprise an ultrasonic horn immersed in a cavitation fluid as previously described. The film is conveyed by guide rollers (not shown) which position the film against a support screen at a predetermined distance from the ultrasonic horn.

The present invention provides microfibers with a very small effective average diameter (average width and thickness), generally less than 20 $\mu$m) from fibrous polymeric materials. The small diameter of the microfibers provides advantages in many applications where efficiency or performance is improved by small fiber diameter. For example, the surface area of the microfibers (or the microfibrillated film) is inversely proportional to fiber diameter allowing for the preparation of more efficient filters. The high surface area also enhances the performance when used as adsorbents, such as in oil-absorbent mats or batts used in the clean up of oil spills and slicks.

Other potential uses include: strong reinforcing microfibers in the manufacture of composite materials to enhance interfacial bonding, multilayer constructions where the wicking effect of the micro-fibrous surface is used to enhance multilayer adhesion or integrity, and micro-loops in hook and loop applications. The microfibers are especially useful as a reinforcing agent in concrete, due to the high surface area (which aids bonding), high tensile strength (which prevents crack formation and migration), rectangular cross-section and low elasticity. Microfibrillated films may also be useful as tape backings or straps to yield an extremely strong tape due to the high modulus and tensile strength of the microfibrillated films. The non-fibrillated surface may be coated with a pressure sensitive adhesive for use as adhesive tapes.

Test Procedures

Tensile Modulus, Tensile Strength

Tensile modulus and tensile strength were measured using an Instron tensile testing machine, Model 1122 (Instron Corp., Park Ridge, Ill.) equipped with a 5 KN load cell, model 2511-317. A cross-head speed of 0.05 m/min was used for all testing. Free-standing samples measuring 12.7 cm×6.4 mm were used. Tests were conducted at 23° C. unless otherwise specified.

Dynamic Mechanical Analysis (DMA)

Freestanding strips of each sample were clamped in the jaws of a Seiko Instruments DMA 200 Rheometer (Seiko Instruments, Torrance, Calif.) equipped with a tensile sample fixture. The samples were tested from −60 to 200° C. at 2° C./minute and 1 Hz. Separation between the jaws was 20 mm.

Differential Scanning Calorimetry (DSC)

Known amounts of sample to be analyzed were weighed in stainless steel Perkin-Elmer DSC pans (Perkin-Elmer Corp., Norwalk, Conn.). A DSC scan was performed on each specimen using a Seiko Instruments SSC/5220H DSC instrument (Seiko Instruments, Torrance, Calif.) in which the samples were cooled to −60° C. for 15 minutes followed by heating to 200° C. at 10° C./min.

Dielectric Constant

Dielectric constant measurements were taken at 1 GHz according to the IPC-TM-650 method (Institute for Interconnecting and Packaging Electronic Circuits, Northbrook, Ill.), using an HP 42921 Impedance Material Analyzer equipped with an HP 16451B Dielectric Test Fixture (Hewlett Packard Co., Palo Alto, Calif.).

Fiber Diameter (EFD)

Microfibrillated webs of the invention were evaluated for air flow resistance by measuring the pressure drop ($\Delta P$) across the web in mm $H_2O$ as outlined in ASTM method F 778-88. The average Effective Fiber Diameter (EFD) of each web in microns was calculated using an air flow rate of 32 L/min according to the method described in Davies, C. N., "The Separation of Airborne Dust and Particles," Institution of Mechanical Engineers, London, *Proceedings* 1B, 1952.

Fiber Transverse Aspect Ratio and Cross-sectional Area

Aspect ratio and area measurements of microfibers obtained from microfibrillation procedures were measured from photomicrographs. Fiber samples were mounted on an aluminum stub and sputter coated with gold/palladium, then examined using a Model 840 Scanning Electron Microscope (JEOL USA, Inc., Peabody, Mass.) at a viewing angle normal to the surface of the stub. The scanning electron micrographs may be seen as FIGS. 1 and 2.

Surface Area

Surface area measurements were performed with a Horiba model SA-6201 instrument (Horiba Instruments, Inc., Irvine, Calif.) using nitrogen as the adsorbate. Samples were conditioned at 20° C. and approximately 760 mm Hg pressure, then measured at ambient temperature (approximately 23° C.) with a saturation pressure differential of 20 mm Hg. Samples were degassed at 60° C. for 800 minutes prior to measurement. A calibration constant of 2.84 was used. A material of known surface area was used as a control material to determine test repeatability.

Density

Density of microfibrillated materials was measured at 25° C. in deionized water according to the method of ASTM D792-86. Samples were cut into 1.27×2.54 cm pieces, weighed on a Mettler AG245 high precision balance (Mettler-Toledo, Inc., Hightstown, N.J.), and placed underwater. The mass of water displaced was measured using the density measurement fixture.

Oil Adsorption

Microfibrillated samples were weighed, then immersed in MP404™ lubricating oil (Henkel Surface Technologies, Madison Heights, Mich.) or Castrol Hypoy™ gear oil (Castrol Industrial North America Inc., Downers Grove, Ill.)

for 60 seconds, then drained on a screen for one hour and re-weighed. All steps were performed at 23° C. Results were recorded as grams of oil adsorbed per gram of adsorbing material.

Electrical Charge

A. Corona charge: The sample was subjected to corona treatment by passing the sample, in contact with an aluminum ground plane, under a positive DC corona source once at a rate of 3.8 m/min at 40 kV, with the current maintained at about 0.01 mA/cm corona source. The corona source was approximately 4 cm from the ground plate.

B. Filtration Performance: Filtration performance and pressure drop of corona charged and uncharged samples were measured by dioctyl phthalate (DOP) penetration using a TSI Model 8010 instrument (TSI, Inc., St. Paul, Minn.) at a flow rate of 32 L/min. For each sample, filtration performance was evaluated according to a Quality Factor QF, defined as $$QF=-\ln\{P(\%)/100\}/\Delta p(\text{mm } H_2O)$$

Where P was the penetration of DOP and Δp was the pressure drop. An increase in QF indicated an improvement in filtration performance.

Acoustical Absorption

Acoustical Absorption was measured essentially according to ASTM method E 1050-90. A weighed sample to be analyzed was placed in a 29 mm diameter model 4026 dual microphone impedance tube (Bruel & Kjaer, Decatur, Ga.) to a depth of 45 mm and subjected to a range of frequencies. A model 2032 dual channel signal analyzer (Bruel & Kjaer) was used to analyze sound absorption of the sample. Data is presented as an absorption coefficient vs. frequency such that an absorption coefficient of 1 indicates complete sound dissipation at the specified frequency.

Preparation of Films

Sample 1. Highly Oriented Polypropylene

A cast polypropylene film (ESCORENE 4502-E1, Exxon Chemical Co., Houston, Tex.) was prepared by extrusion. The extruder settings were: 235–250–270–250° C. from input end to die, at 60 rpm. Extruded material was chilled on a water-cooled roll at 36° C., to produce a film of approximately 2.54 mm thickness. The extruded film was length-oriented at 135° C. at a 5:1 draw ratio in the machine direction and collected on a roll. The film was fed into a 4-roll calendering apparatus, with each roll steam-heated to approximately 150° C., at 1.5 m/min. A nip force between the third and fourth rolls effected a biaxial 2:1 draw ratio on the film, which was then fed into a length-orienter with only a 2.54 cm space between the nip roll and the first length-orienting roll. The length orienter used a series of rolls in such a way that an additional 10:1 draw ratio was achieved while lowering the roll temperature to 23° C. The oriented film was passed through a nip-roller to maintain tension, then taken up on a roll. A total draw ratio of 20:1 was achieved such that the produced film was approximately 0.25 mm thick.

The resultant film had a tensile modulus of 8.9 GPa and a tensile strength of 496 MPa. Tensile dynamic mechanical analysis (DMA) showed an approximately 10-fold increase in modulus over non-oriented polypropylene at temperatures from −50° to 150° C. The sample showed a degree of crystallinity of approximately 95%, as calculated from differential scanning calorimetry (DSC) measurements. The z-direction (i.e., in the direction of the film thickness) dielectric constant at 1 GHz was 1.92, with a dissipative tan delta of 0.15 milliunits.

Sample 2. Highly Oriented Polypropylene

Polypropylene film was prepared by extruding polypropylene homopolymer (FINA 3374X or FINA 3271, commercially available from Fina Inc., Dallas, Tex.) at 40 rpm with an extruder temperature profile of 229° C.–239° C.–247° C.–246° C. from feed to tip. The neck tube and die were maintained at 246° C. Films having a thickness of 1.6 mm were prepared using a casting wheel temperature of either 23° C. ('cold cast') or 90° C. ('hot cast').

The cast films were calendered using a two-roll calender at 150° C., with the first (input) roll set at 0.31 m/min and 4.15 MPa and the second (take-up) roll set at 2.13 m/min. Stretch ratios of 12:1 were measured using the deformation of a grid inscribed on the film.

One method of length orientation of films of the invention used a series of six 15 cm diameter preheat rolls (90° C.) arranged such that each side of the film came in contact with three rolls (Brückner Maschinenbau GmbH, Siegsdorf, Germany). The rolls had a surface speed of 1 m/min. The film was stretched between two 7.3 cm diameter rolls heated at 90° C., the first of which had a surface speed of 1 m/min and the second having a surface speed of 4 m/min. The stretched film then passed over two additional 15 cm diameter rolls heated at 90° C. such that each side of the film came in contact with a roll, in order to heat-relax the film. The film was immediately wound onto a take-up reel.

Additional length orientation of the film was carried out in an elongated oven having a temperature profile of 160° C. in zones 1, 2, and 3, and 145° C. in zone 4. The film was introduced into the oven at 1 m/min and drawn at the output end at 3.6 m/min. The oriented film was cooled to 23° C. over a series of unheated rolls, then wound onto a take-up reel. Draw ratio for this procedure was 1.6:1, measured using grid deformation as described previously. The overall draw ratio for all operations was 19:1. Tensile properties of the films are shown in Table 1. The microvoided morphology of Sample 2–7 can be seen with reference to FIG. 3.

All films described in Table 1 were calendered as described above. In addition, some films were length oriented (LO). All films were either cold cast (CC) or hot cast (HC), as indicated in the table. Tensile strength and Modulus values are reported as the average of five readings taken at 23° C. at the center of the film after the orientation procedure was complete.

TABLE 1

| Film Sample | Treatment | Thickness, mm | Tensile Strength, MPa | Tensile Modulus, GPa |
|---|---|---|---|---|
| 2-1* | HC, LO | 0.11 | 531 | 8.00 |
| 2-2* | HC | 0.14 | 390 | 4.71 |
| 2-3** | HC, LO | 0.14 | 527 | 7.12 |
| 2-4** | | 0.14 | 316 | 4.42 |
| 2-5** | HC | 0.17 | 382 | 3.81 |
| 2-6** | HC, LO | 0.13 | 530 | 7.48 |
| 2-7** | HC, LO | 0.13 | 492 | 6.80 |
| 2-8* | CC | 0.16 | 314 | 3.70 |
| 2-9* | CC, LO | 0.15 | 333 | 3.90 |

*Fina 3374X polypropylene
**Fina 3271 polypropylene

The data of Table 1 show that the highest combinations of tensile modulus and tensile strength can be obtained when the film is both hot cast and length oriented (Samples 2-1, 2-3, 2-6 and 2-7).

Sample 3. Oriented Polypropylene Film

Oriented polypropylene film was prepared by extruding polypropylene (Type 3374X, Fina, Inc.) using a 4.4 cm diameter extruder equipped with a 15 cm die. The initial film (1.63 mm thick) was cast onto a casting drum at 85° C., then length-oriented by calendering between two rolls kept at 152° C., exerting a pressure of 5520 kPa on the film, followed by further length orientation between a heated roll (138° C.) and a cooled roll (14° C.). The resulting draw ratio was 12.7:1. The oriented film exhibited a modulus of 2.1 GPa and a tensile strength of 124,200 kPa, and had a fibrous-pitted microvoided surface morphology on the side away from the cast wheel, while being smooth on the cast wheel side.

Sample 4. Oriented Polypropylene Film

Oriented polypropylene film was prepared by extruding polypropylene (FINA 3374X, Fina Inc.) at 50 rpm in a single screw extruder with a temperature profile of 230° C.–240° C.–250° C.–245° C. from feed to tip. The neck tube and the die were maintained at 245° C. A 1.6 mm thick cast sheet was obtained using a casting wheel maintained at 90° C. The cast sheet was length oriented without a calendering step using six 15 cm rolls heated at 95° C., as described in Sample 2, at a draw ratio of 6:1. Additional length orientation of the film was carried out in a tenter oven having a temperature profile of 150° C. in zone 1 and 130° C. in zones 2, 3, and 4. The film was introduced into the oven at 1 m/min and drawn at the output end at 3.6 m/min. The oriented film was cooled to 23° C. over a series of unheated rolls, then wound onto a take-up reel. Draw ratio for this procedure was 1.25:1, measured using grid deformation as described previously. Finally, the drawn film was further stretched in a retensilizer apparatus in which the second set of rolls was maintained at 120° C., to produce an additional 1.5:1 stretch. The overall draw ratio for all operations was 11:1, producing a film having 71% crystallinity (DSC). Tensile modulus of film thus obtained was 8.3 GPa ($1.2\times10^6$ psi), tensile strength was 331 MPa (47,900 psi).

EXAMPLE 1

Fluid Jet Microfibrillation

Fibrillation of oriented polypropylene films by fluid jet was carried out using a Model 2303 hydroentangling machine (Honeycomb Systems Inc., Bridgeport, Me.) equipped with a 61 cm die having 0.13 mm diameter holes spaced 0.39 mm apart (pitch). Deionized water (23° C.) at a pressure of from 8280 kPa to 9660 kPa was used throughout all examples. Typical line speed was between 0.9 and 1.3 m/min, unless otherwise noted.

In a typical procedure, highly oriented polypropylene film, as described above, was supported on a continuous mesh screen and passed under the hydroentangler jets at the prescribed rate at a distance of approximately 3 cm from the die. The resultant microfibrillated film was taken up on take-up roll.

Highly oriented polypropylene film, Sample 2–7, was subjected to fluid jet microfibrillation using the general procedure described above. Thus, a film sample 1.27 cm wide and 0.125 mm thick was passed under the hydroentangler die at a distance of about 3 cm, on a screen having 1.25 mm×1.25 mm openings, with water jet pressure of 8280 kPa. The resultant microfibrillated web was 0.375 mm thick. Physical properties of the microfibrillated web were:

| Orientation | Modulus, MPa | Tensile Strength, MPa | Max. Load at break, N | Strain at Break, % |
|---|---|---|---|---|
| Machine direction (MD) | 2,300 | 72.5 | 123 | 8.6 |
| Transverse direction (TD) | 138 | 0.26 | 0.44 | 272 |

Effective Fiber Diameter (EFD): 0.5–0.7 micrometers

Surface Area: 4.01 $m^2/g$

Density: 0.104 g/cc

Oil Adsorption (MP404 lubricant): 14.42 g/g

Oil Adsorption (Hypoy C Gear Oil): 19.29 g/g

Filtration performance, before corona charge: QF=0.03

Filtration performance, after corona charge: QF=0.33

Average aspect ratio: 6±3:1 (n=24)

Average cross-sectional area: 1.4±0.7 $\mu$m (n=24)

Acoustical Absorption: Absorption coefficient greater than 0.85 between 650 and 5000 Hz.

Figure 4:
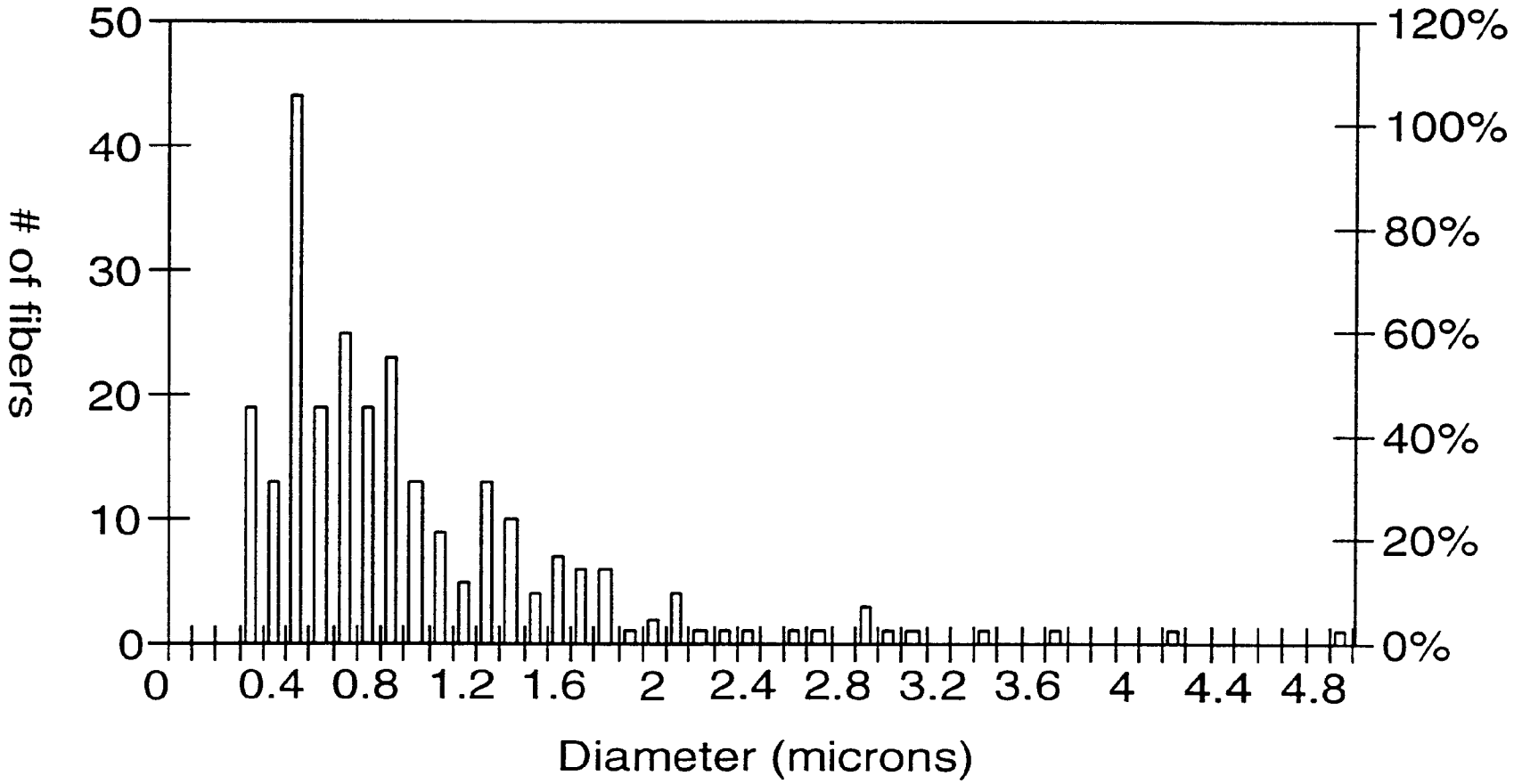
FIG. 4 is a histogram of the effective average fiber diameter of the microfibers of Example 1.

Scanning electron micrographs (SEMS) of the microfibers can be seen in FIGS. 1 and 2, revealing the novel ribbon-like microfibers of the invention. A histogram of the effective average fiber size is plotted as FIG. 4. In FIG. 4, the aspect ratios (width to thickness) were averaged to obtain the reported diameters.

EXAMPLE 2

Ultrasonic Microfibrillation

A 0.225 mm thick sample of highly-oriented polypropylene film, described in the preparation of Sample 1, was subjected to ultrasonic microfibrillation. An Autotrack 3000 ultrasonic system (Dukane Corp., St. Charles, Ill.) was used in a water tank filled with water with the horn positioned such that the working surface of the horn was about 3 cm. below water level. A high gain bar horn having a 5 cm diameter top and a ⅜×2 inch (9.5×51 mm) rectangular bottom was used, in conjunction with a 0.6:1 booster. The amplitude was 0.045 mm peak to peak. The film was held in close proximity to the horn. The resulting film was microfibrillated on both sides such that the overall thickness in the microfibrillated zone was approximately 0.375 mm thick, while a 0.125 mm thick non-microfibrillated portion remained at the core, between the microfibrillated surfaces. Contact time for microfibrillation was 2 minutes. Microfibrils having diameters in the range of 0.1 to 10 micrometers were observed by scanning electron microscopy. It is believed that microfibers below the detection limit of SEM were also present.

EXAMPLE 3

Ultrasonic Microfibrillation

The oriented polypropylene film described in the preparation of Sample 3 was subjected to ultrasonic microfibrillation. A water tank having inlet and outlet slits on each side was filled to about 7.5 cm depth with water. An Autotrack 3000 ultrasonic system (Dukane Corp., St. Charles, Ill.) was used with the horn positioned such that the horn was below water level and above a screen having 3 mm holes mounted on an open ring approximately 3.5 cm high secured to the bottom of the water tank. The distance between the horn and the screen was kept to a minimum, for example, 0.25 mm for a 0.225 mm-thick film sample. A high-amplitude bar horn having a 5 cm diameter top and a ⅜×2 inch (9.5×51 mm) rectangular bottom was used, in conjunction with a 1.5:1 booster. The oriented film was led into the inlet slit, under the ultrasonic horn, i.e., under water, and out the outlet slit under sufficient tension to keep the film in close contact with the working surface of the horn. Amplitude was 0.185 mm. Contact time for microfibrillation was approximately 2 M/minute (~6 feet/minute). Microfibrillation was observed only on the formerly fibrous-pitted surface of the film. It was noted that this microfibrillation took place on the fibrous-pitted surface whether that surface was facing or away from the ultrasonic horn.

EXAMPLE 4

Water Jet Microfibrillation.

Oriented polypropylene film obtained as described in Sample 4 was subjected to microfibrillation with water jets using a 10 cm three orifice neutral balanced swirling head attached to a Jet Edge water cutting table equipped with three axis controls that was adjusted to produce $7.6\times10^{-3}$ $m^3$ (2 gallons) of water at 248 MPa (36,000 psi) (Jet Edge, Minneapolis, Minn.). The actual water pressure was 34.5 MPa (5000 psi) at a film speed of 1.3 m/min past the stationary swirling head. Microfibers obtained from the film were shown by SEM to be relatively flat, ribbon-like fibers having their widest dimension from less than 1 micrometer to about 9 micrometers and a thickness of approximately 0.5 micrometers, such that the aspect ratios of the fibers were from 2:1 to about 18:1.

Comparative Example 1

A biaxially-oriented polypropylene film (FINA 3374X) was prepared by extrusion from a single-screw extruder at 232° C. onto a 23° C. casting wheel. The film was stretched in a roll-to-roll length orienter at 129° C. and stretched in the transverse direction in a tenter frame oven, as described in the preparation of Sample 2, to obtain a 7×7 draw ratio. The stretching conditions were chosen so no microvoids were imparted to the film. The final film thickness was 0.037 mm. Ultrasonic treatment of the film, as described in Example 3, did not provide microfibrillation, but delaminated the film into thin layers.

Various modifications and alterations of the invention will be apparent to those skilled in the art without departing from the scope of this invention, and it should be understood that this invention is not to be unduly limited to the illustrative embodiments set forth herein.

We claim:

1. Melt processed polymeric microfibers having an average effective diameter of less than 20 microns and a transverse aspect ratio of from 1.5:1 to 20:1.

2. The microfibers of claim 1 having a transverse aspect ratio of 3:1 to 9:1.

3. The microfibers of claim 1 having a cross-sectional area of 0.5 $\mu^2$ to 3.0 $\mu^2$.

4. The microfibers of claim 1 having a cross-sectional area of 0.7 $\mu^2$ to 2.1 $\mu^2$.

5. The microfibers of claim 1 having an average effective diameter of from 0.01 microns to 10 microns.

6. The microfibers of claim 1 having a surface area of at least 0.25 $m^2$/gram.

7. The microfibers of claim 1 having a surface area of 0.5 to 30 $m^2$/gram.

8. A highly oriented melt processed film, having at least one surface comprising the microfibers of claim 1.

9. The microfibers of claim 1 wherein said melt-processed polymer is selected from the group consisting of high and low density polyethylene, polypropylene, polyoxymethylene, poly(vinylidine fluoride), poly(methyl pentene), poly(ethylene-chlorotrifluoroethylene), poly(vinyl fluoride), poly(ethylene oxide), poly(ethylene terephthalate), poly(butylene terephthalate), nylon 6, nylon 66, polybutene, and thermotropic liquid crystal polymers.

10. The microfibers of claim 1 wherein said melt-processed polymer is selected from the group consisting of high density polyethylene, polypropylene, and the molecular weight of said polymers is from about 5,000 to 499,000.

* * * * *